US005464378A

United States Patent [19]

Yu

[11] Patent Number: 5,464,378

[45] Date of Patent: Nov. 7, 1995

[54] FOLDABLE EXERCISER HORSE

[75] Inventor: Hei-Nan Yu, Taou Yuen, Taiwan

[73] Assignee: Kuo-Ron Lee, Yi Lan, Taiwan

[21] Appl. No.: 265,736

[22] Filed: Jun. 27, 1994

[51] Int. Cl.[6] ..... A63B 69/06

[52] U.S. Cl. ..... 482/95; 482/72; 482/57

[58] Field of Search ..... 482/142, 95, 72, 482/123, 96, 57; 472/106, 110, 120

[56] References Cited

U.S. PATENT DOCUMENTS

| | | | |
|---|---|---|---|
| 4,300,760 | 11/1981 | Bobroff | 482/95 |
| 5,256,126 | 10/1993 | Grotstein | 482/142 |

FOREIGN PATENT DOCUMENTS

| | | | |
|---|---|---|---|
| 2186498 | 8/1987 | United Kingdom | 482/22 |
| 9218204 | 10/1992 | WIPO | 482/95 |

*Primary Examiner*—Stephen R. Crow
*Assistant Examiner*—Jerome Donnolly
*Attorney, Agent, or Firm*—Bacon & Thomas

[57] ABSTRACT

A foldable exerciser horse comprising plural sets of pivotally connected frame members, such that a user may imitate the movements of riding to manipulate the exerciser horse and achieve the effect of exercise. Since all the frame members are pivotally connected, the entire exerciser horse can be folded to a minimal volume for convenient packing, storage, and transportation.

6 Claims, 5 Drawing Sheets

FOLDABLE EXERCISER HORSE

BACKGROUND OF THE INVENTION

Since riding has become an increasingly popular sport, various kinds of training or exercise equipments for such sport have been researched and developed by the sporting industry, and exerciser horse is one example of these equipments which not only provides a user the pleasure riding but also the effect of riding training and robust body.

FIG. 1 illustrates a conventional riding exerciser which is sold under the ommerical name of "Health Rider". With it a user may enjoy riding and exercising at the same time while only limited space is required, and therefore, it is considerably welcomed nowadays. However, such conventional riding exerciser has some disadvantages in its structure as follows:

1. The joints between members thereof are either fixedly welded together or connected by means of screws, and therefore, the whole body can not be easily disassembled once it has been assembled. This of course forms a confusion in packing such product and increases the cost of freight. Moreover, although such riding exerciser provides the user acceptable effect, it bothers the user due to its occupancy of large space. It is therefore desirable to develop a riding exerciser which may eliminate the above shortcomings and improve the conventional riding exerciser.

SUMMARY OF THE INVENTION

A primary object of the present invention is therefore to provide an exerciser horse which has simple structure and can be easily folded to minimize the space required by the product in packing, transportation, and storage, and be effortlessly unfolded for use without any complicated procedures.

The exerciser horse according to the present invention is a foldable riding exerciser capable of swaying back and forth, up and down, and mainly consists of a plurality of frame members pivotally connected with one another, such that the user may imitate the movements of riding to achieve the effect of exercise. According to the manner the user manipulates the handle of the exerciser horse, muscles at different areas of the user, such as his or her two arms, abdomen, upper part and/or lower part of the body, can be particularly strengthened. Moreover, the exerciser horse of the present invention is foldable when it is not in use and, therefore, occupies minimal space which reduces the cost of freight and minimizes the room required for storage. All of these enhance the practical benefits and value of the present invention.

DETAILED DESCRIPTION OF THE PREFERRED EMBODIMENT

Figure 1:
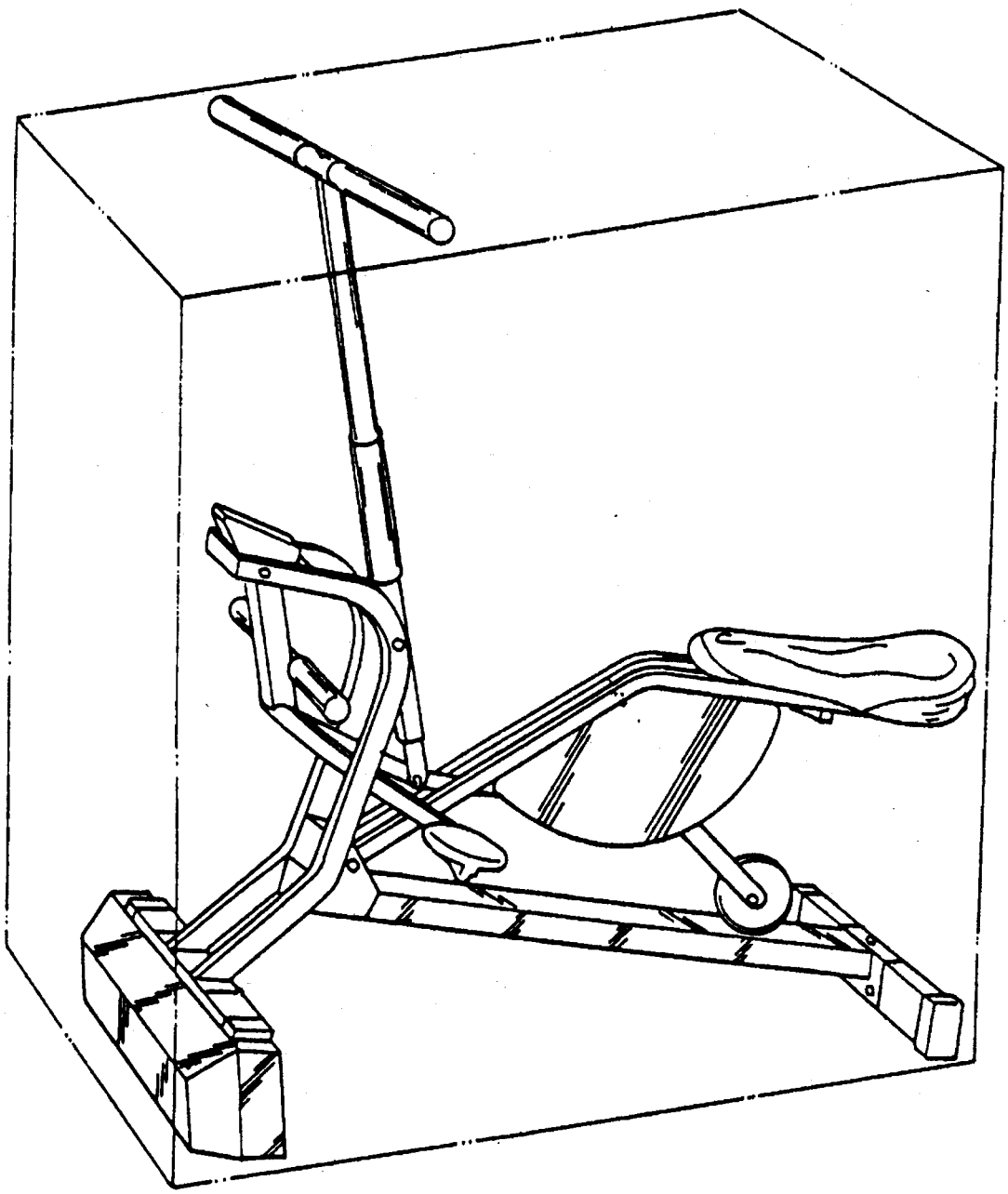
PRIOR ART FIG 1
FIG. 1 is a perspective view of a conventional riding exerciser, showing the manner and the space required to pack a completed product of this type.
Figure 2:
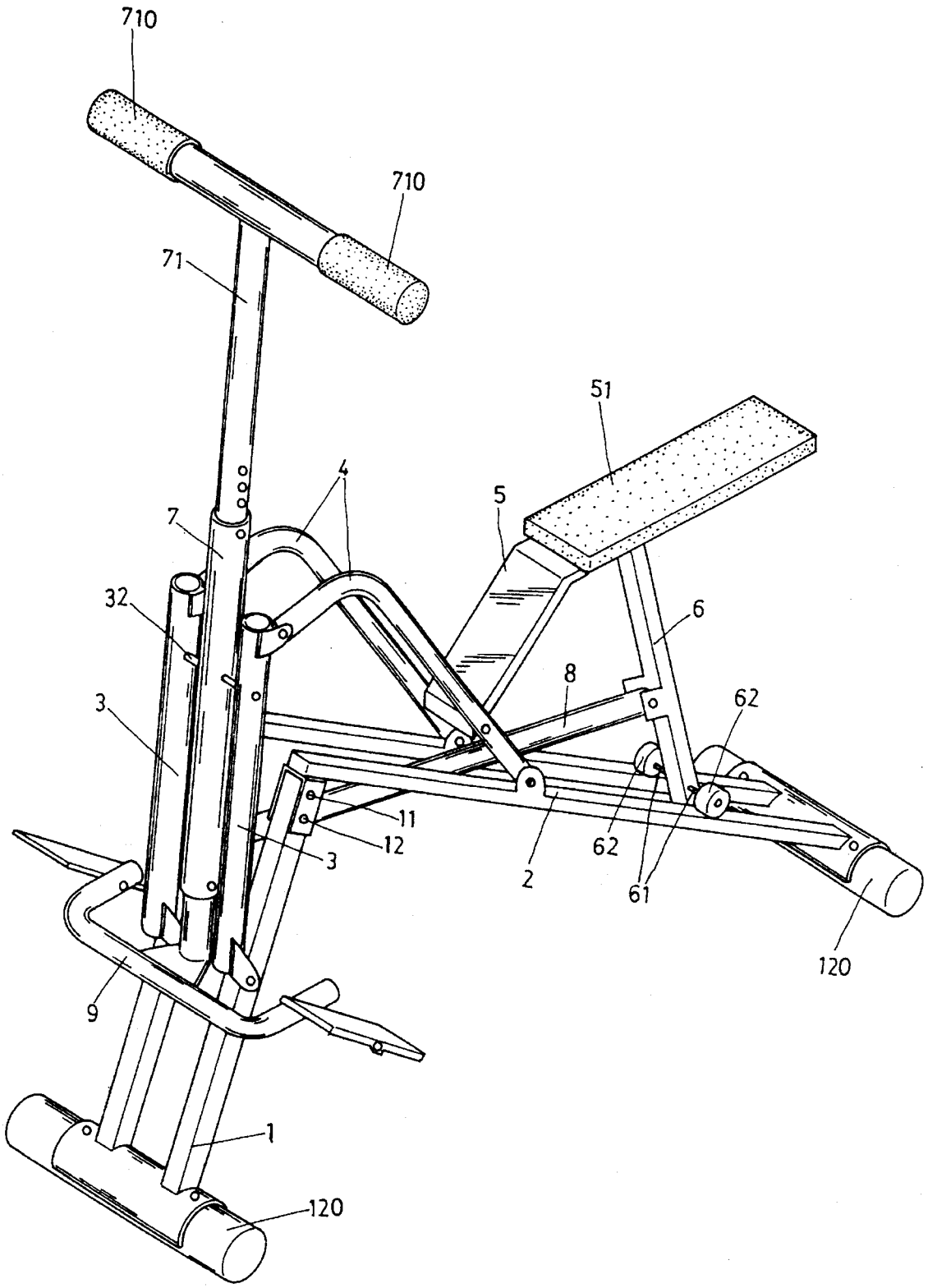
FIG. 2 is an assembled perspective view of an exerciser horse according to the present invention.
Figure 3:
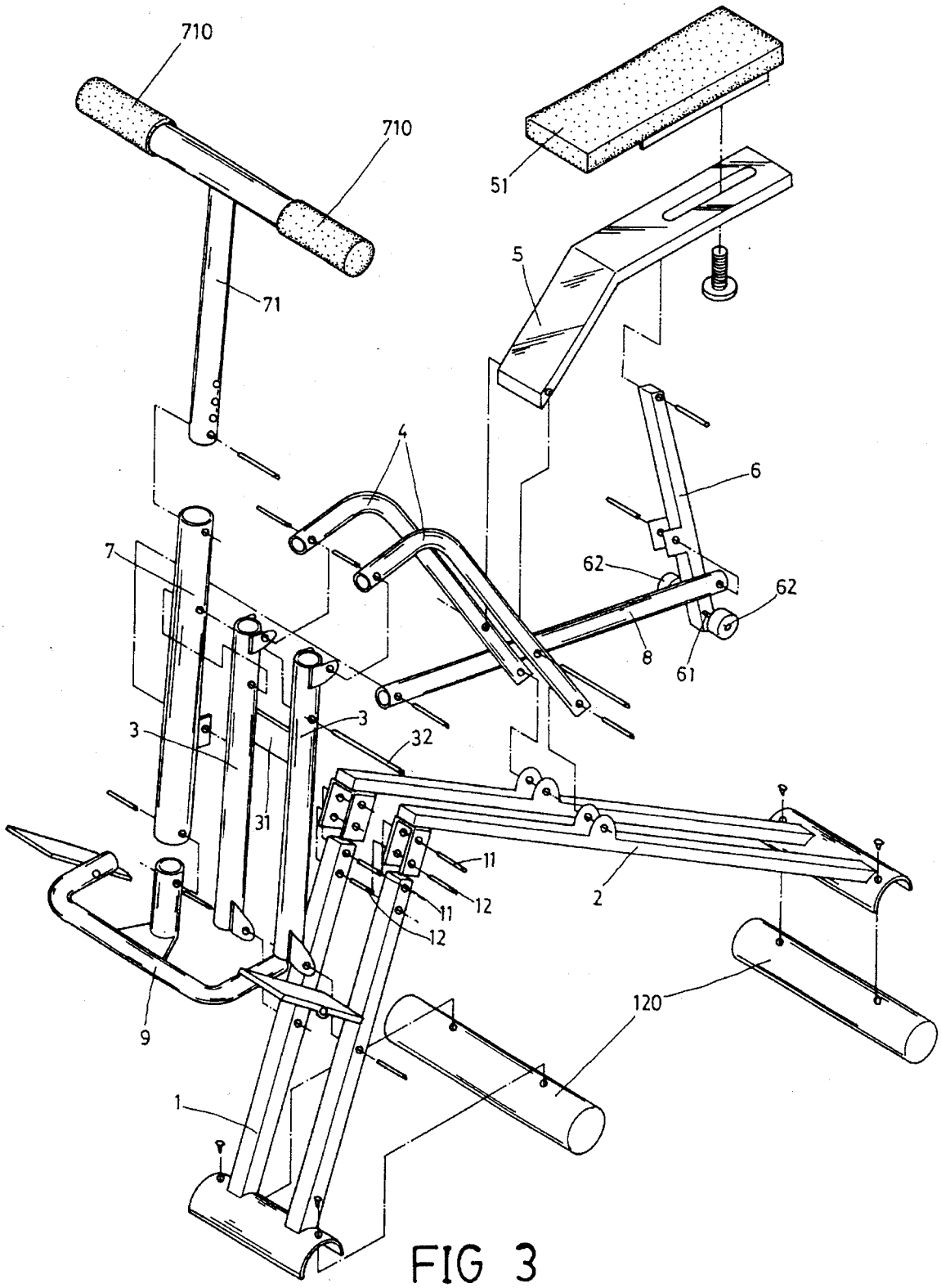
FIG. 3 is an exploded perspective view of the exerciser horse according to the present invention.

Please refer to FIGS. 2 and 3. The present invention is an exerciser horse capable of swaying back and forth, up and down, and more particularly an exerciser horse which is foldable when it is not in use.

The exerciser horse according to the present invention mainly includes a pair of parallell spaced front supports 2, a pair of parallel spaced rear supports 2, a pair of parallel spaced front stems 3, a pair of parallel spaced rear stems 4, a seat support 5 with a seat 51 attached thereon, a seat pillar 6, a rocker 7, a handle 71 with two grips 710, a pull-rod 8, a foot-rest 9 with two fixed pedals, and two support bases 120 separately connected to lower ends of the front and the rear supports 1, 2.

Each front support 1 is pivotally connected with a corresponding rear support 2 at their upper ends by means of a pivot pin 11 and a fixing pin 12, such that the connected front and rear support pairs 1, 2 may be extended about their pivoting point, i.e., their upper ends, to form a predetermined angle between them, or be turned about the same pivoting point to form a folded position.

Each front stem 3 is pivotally connected at its lower end to a corresponding front support 1 at a predetermined adequate point on the front support 1, and at its upper end to a corresponding rear stem 4 at an upper end thereof. Each rear stem 4 is pivotally connected at its lower end to a corresponding rear support 2 at a predetermined adequate point on the rear support 2, such that the rear stems 4 and the front stems 3 may be turned about their pivoting point, i.e., their upper ends, to separate from or get close to each other to form an extended or a folded state, respectively, to match with the extension or folding of the front supports 2 relative to the rear supports 2, respectively.

The seat support 5 has a front lower end pivotally connected to and disposed between the two rear stems 4 at a predetermined point thereof, and a rear upper portion substantially extending in a horizontal direction to receive the seat 51 thereon. The seat pillar 6 is pivotally connected at its upper end to a bottom side of the seat support 5. The seat pillar 6 has a lower end through which a roller pin 61 transversely extends to connect a roller 62 at each end thereof, such that the two rollers 62 may roll on a top surface of the two rear supports 2 to smoothly move the lower end of the seat pillar 6 back and forth between the two parallel spaced rear supports 2.

The rocker 7 is disposed between the two parallel spaced front stems 3 and is pivotally connected thereto at a predetermined point near an upper portion of the two front stems 3 by means of a pivot pin 32. A stop member 31 extends between the two front stems 3 and is fixedly connected thereto at a predetermined point near a rear middle portion of the rear stems 3 so as to limit a space within which the rocker 7 may be swayed back and forth about the pivot pin 32.

The handle 71 is movably inserted into the rocker 7 from a top end of the rocker 7, acting as reins for the user to control the sway of the rocker 7 by holding the two grips 710 and pulling or pushing the same.

The pull-rod 8 has a front end pivotally connected to the rocker 7 at a point near a rear lower portion of the rocker 7, and a rear end pivotally connected to the seat pillar 6 at a point near a middle portion thereof, such that when the handle 71 is subjected to an outcoming force, the rocker 7 is brought to drive the pull-rod 8 to pull or push the seat pillar 6, the seat support 5, and the seat 51 to produce a series of movements similar to horseback riding.

The foot-rest 9 is detachably attached to a lower front end of the rocker 7 with the two pedals fixedly disposed at two sides of the two front supports 1.

Figure 4:
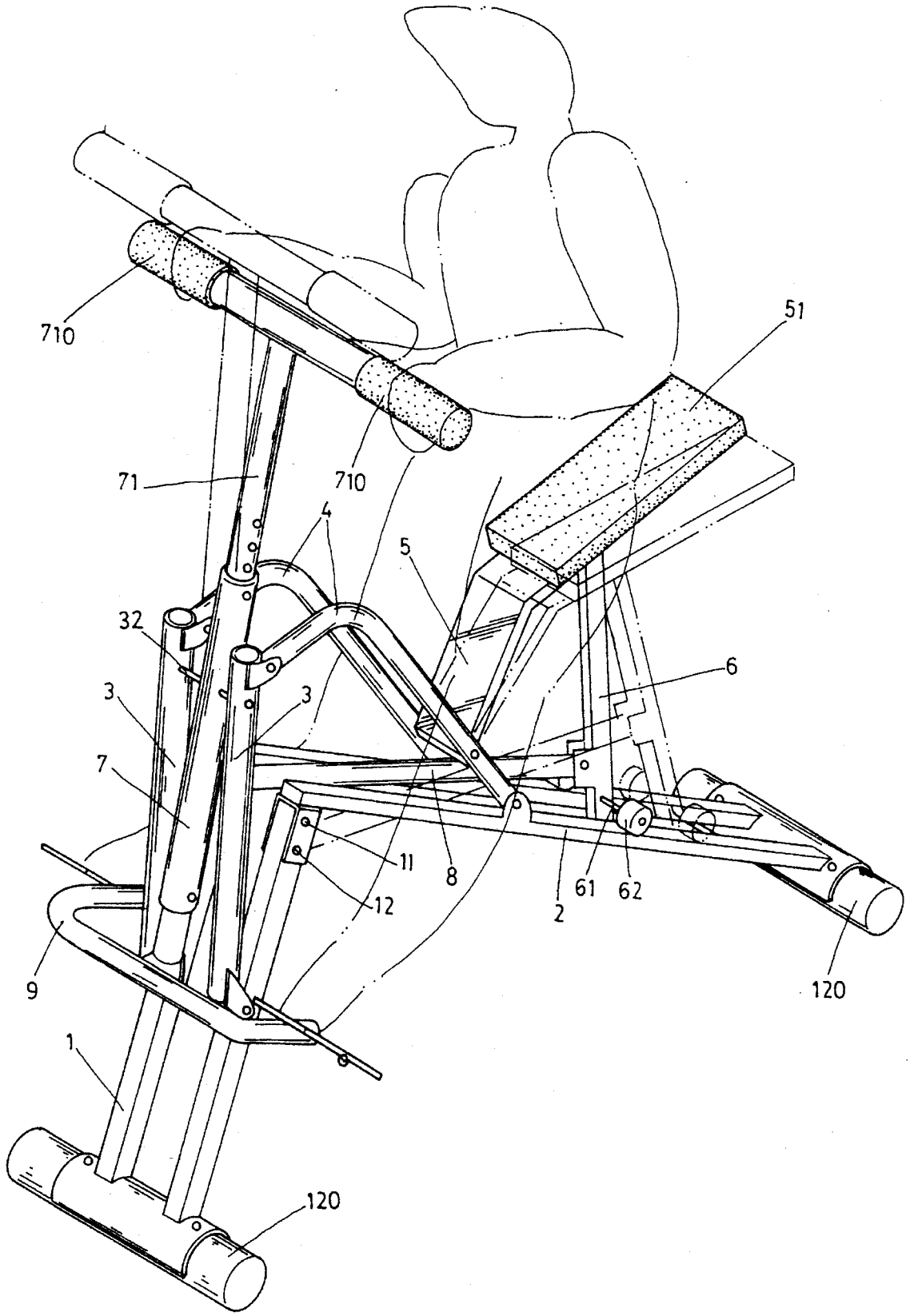
FIG. 4 illustrates the manner in which a user manipulates the exerciser horse of the present invention.

When the user sits on the seat 51 above the seat support 5 with his or her two hands gripping the grips 710 and two feet resting on the two pedals, any force differently applied by the user on the handle 71 may cause different parts of the exerciser horse to sway back and forth, or up and down, giving different areas of the user's body, such as the two arms, the upper trunk, the-lower trunk, and the abdomen, sufficient exercise effect. As shown in FIG. 4, such body movements achieved by the user through manipulating the exerciser horse are similar to those one would have when horse back riding.

Figure 5:
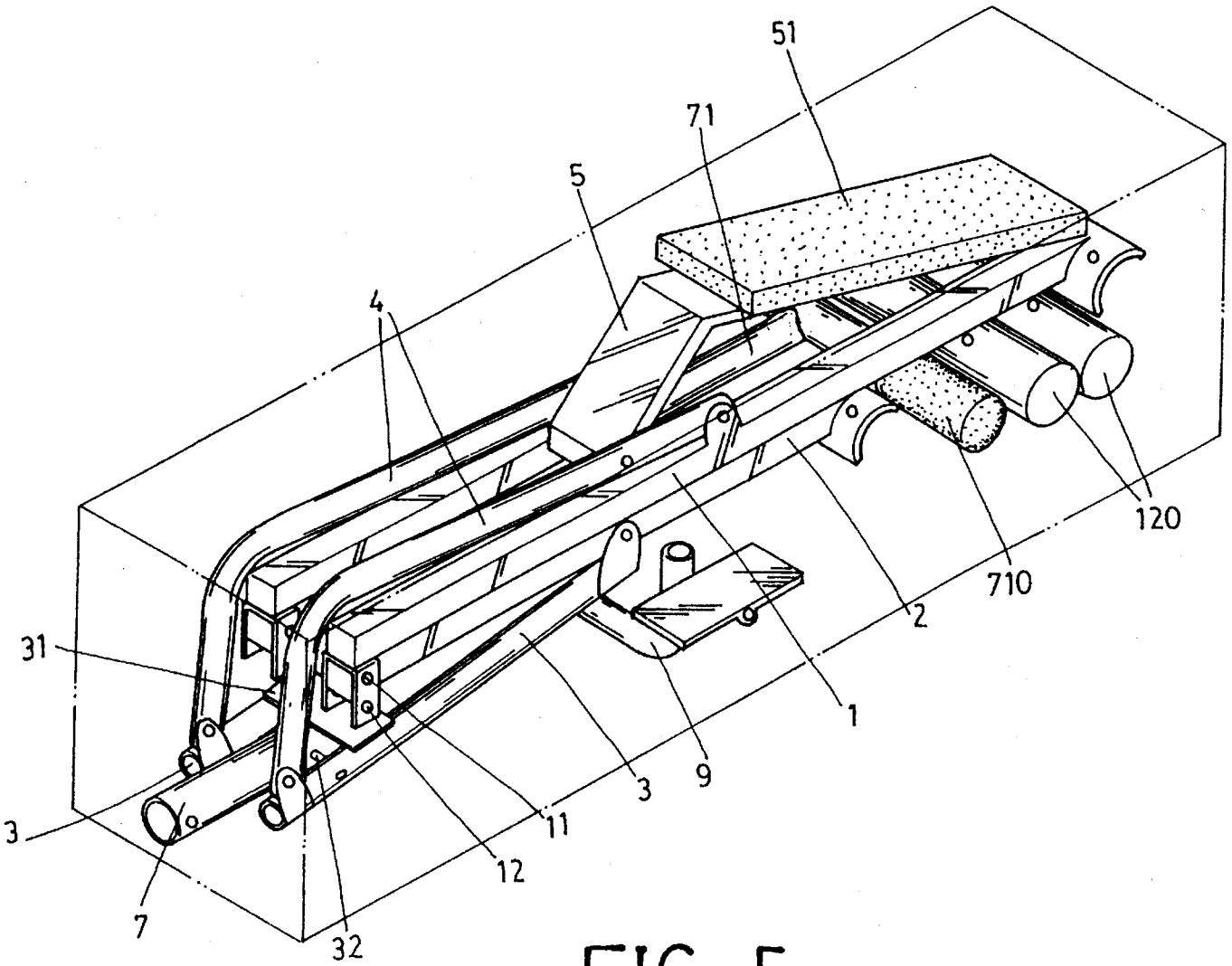
FIG. 5 illustrates a folded exerciser horse of the present invention and the packing thereof.

Since all the structural members and parts of the exerciser horse of the present invention are pivotally connected at their joints while the support bases 120 and the grips 710 are detachable, the entire exerciser horse can be folded and collapsed to a minimal volume without projecting portions for convenient packing, storage and transportation, as shown in FIG. 5.

What is claimed is:

1. A foldable exerciser horse comprising:

a) a pair of spaced parallel front supports including a pair of upper ends and a pair of lower ends;

b) a pair of spaced parallel rear supports including a pair of upper ends and a pair of lower ends;

c) the upper ends of the front supports being pivotally connected to the upper ends of the rear supports;

d) a pair of spaced parallel front stems including a pair of upper ends and a pair of lower ends, and a pair of spaced parallel rear stems including a pair of upper ends and a pair of lower ends;

e) the lower ends of the front stems being pivotally connected to the front supports between the upper and lower ends of the front supports, the upper ends of the front and rear stems being pivotally connected together, and the lower ends of the rear stems being pivotally connected to the rear supports between the upper and lower ends of the rear supports;

f) a rocker member pivotally connected to the front stems adjacent the upper ends of the front stems, and a handle mounted on the rocker member;

g) a seat support including a lower end pivotally connected to the rear stems between the upper and lower ends of the rear stems and an upper portion for supporting a seat thereon, and a seat pillar including a top end pivotally connected to the upper portion of the seat support and a lower end for moveable engagement with the rear supports;

h) a pull rod including a front end pivotally connected to the rocker member and a rear end pivotally connected to the seat pillar between the upper and lower ends of the seat pillar; and i) whereby the exerciser horse may be folded by pivoting the front supports against the rear supports, the front stems towards the upper ends of the front supports, the rear stems towards the upper ends of the rear supports, and the seat pillar between the rear supports.

2. The foldable exerciser horse of claim 1 wherein the lower end of the seat pillar includes a pair of rollers disposed in rolling engagement with the rear supports.

3. The foldable exerciser horse of claim 1 further including a seat means mounted on the upper portion of the seat support.

4. The foldable exerciser horse of claim 1 further including a foot rest detachably connected to the rocker member and a pair of pedals mounted on opposite sides of the foot rest.

5. The foldable exerciser horse of claim 1 further including a support base mounted to the lower ends of each of the front supports and the rear supports.

6. The foldable exerciser horse of claim 1 further including a stop member secured between the pair of front stems for defining a limited space within which the rocker member may pivot.

* * * * *